US009395049B2

(12) United States Patent
Vicknair et al.

(10) Patent No.: US 9,395,049 B2
(45) Date of Patent: Jul. 19, 2016

(54) APPARATUS AND METHODS FOR DELIVERING A HIGH VOLUME OF FLUID INTO AN UNDERGROUND WELL BORE FROM A MOBILE PUMPING UNIT

(71) Applicant: Baker Hughes Incorporated, Houston, TX (US)

(72) Inventors: Bruce A Vicknair, The Woodlands, TX (US); Blake Burnette, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 228 days.

(21) Appl. No.: 13/948,483

(22) Filed: Jul. 23, 2013

(65) Prior Publication Data

US 2015/0027712 A1 Jan. 29, 2015

(51) Int. Cl.

| | |
|---|---|
| ***F17D 1/08*** | (2006.01) |
| ***E21B 41/00*** | (2006.01) |
| ***E21B 43/26*** | (2006.01) |
| ***E21B 43/16*** | (2006.01) |

(52) U.S. Cl.

CPC . *F17D 1/08* (2013.01); *E21B 41/00* (2013.01); *E21B 43/162* (2013.01); *E21B 43/26* (2013.01); *Y10T 137/6881* (2015.04)

(58) Field of Classification Search

CPC ..... F17D 1/08; E21B 43/162; E21B 43/26; E21B 41/00

See application file for complete search history.

(56) References Cited

U.S. PATENT DOCUMENTS

| | | | | |
|---|---|---|---|---|
| 4,159,180 | A | 6/1979 | Cooper et al. | |
| 4,311,395 | A | 1/1982 | Douthitt et al. | |
| 4,368,396 | A | 1/1983 | Humphrey | |
| 5,839,888 | A | 11/1998 | Harrison | |
| 6,230,805 | B1 | 5/2001 | Vercaemer et al. | |
| 6,388,353 | B1 | 5/2002 | Liu et al. | |
| 7,921,914 | B2 | 4/2011 | Bruins et al. | |
| 8,789,601 | B2 * | 7/2014 | Broussard et al. | 166/308.1 |
| 2006/0260331 | A1 | 11/2006 | Andreychuk | |
| 2008/0152517 | A1 | 6/2008 | Ishii et al. | |
| 2009/0044951 | A1 | 2/2009 | Milkovisch et al. | |
| 2009/0068031 | A1 * | 3/2009 | Gambier | F04B 17/05 417/364 |
| 2010/0132949 | A1 * | 6/2010 | DeFosse et al. | 166/308.1 |
| 2012/0255734 | A1 * | 10/2012 | Coli | E21B 43/26 166/305.1 |

(Continued)

FOREIGN PATENT DOCUMENTS

| | | | |
|---|---|---|---|
| CA | 2546315 | A1 | 11/2006 |
| WO | 2012122636 | | 9/2012 |

OTHER PUBLICATIONS

"The Application of Flexible Couplings for Turbomachinery", Robert E.Munyon, John R. Mancuso and C.B. Gibbons, Proceedings of the 18th Turbomachinery Symposium, Texas A&M University, College Station, Texas, 1989, 25pp.

(Continued)

*Primary Examiner* — Zakiya W Bates
*Assistant Examiner* — Crystal J Miller
(74) *Attorney, Agent, or Firm* — E. Randall Smith; Jones & Smith, LLP

(57) ABSTRACT

Apparatus for pumping fluid into an underground well bore at a well site and being transportable between multiple well sites includes a chassis configured to be transportable between well sites, first and second fluid pumps disposed upon the chassis and configured to pump pressurized fluid into the well bore at the same time and an electric motor disposed upon the chassis and configured to concurrently drive both pumps.

21 Claims, 2 Drawing Sheets

(56) References Cited

U.S. PATENT DOCUMENTS

| | | | | |
|---|---|---|---|---|
| 2013/0045117 | A1* | 2/2013 | Wishart | F04B 17/03 417/53 |
| 2013/0101438 | A1 | 4/2013 | Cedrone et al. | |
| 2013/0306322 | A1* | 11/2013 | Sanborn et al. | 166/308.1 |
| 2014/0010671 | A1* | 1/2014 | Cryer et al. | 417/53 |
| 2014/0174717 | A1* | 6/2014 | Broussard et al. | 166/66.4 |

OTHER PUBLICATIONS

"Permanent-magnet AC Motors", Machine Design, Jim Murphy, machinedesign.com, Apr. 1, 2012, 6pp.
"Overview Rhine Pump Units Maximize pressure pumping efficiency and reliability", Baker Hughes, 2012, 1pp.
"Case History Rhino Bifuel Pumps Replaced Diesel with Cleaner Burning Natural Gas", Baker Hughes, 2013, 1pp.

* cited by examiner

APPARATUS AND METHODS FOR DELIVERING A HIGH VOLUME OF FLUID INTO AN UNDERGROUND WELL BORE FROM A MOBILE PUMPING UNIT

FIELD OF THE DISCLOSURE

The present disclosure relates generally to fluid pumping operations and, more particularly, to apparatus and methods for delivering a high volume of fluid from a mobile pumping unit into an underground well bore.

BACKGROUND

In the hydrocarbon exploration and production industries, various operations require the pumping of fluid into an underground well bore. In many instances, it is necessary to pump a large volume of fluid into the well bore. For example, hydraulic fracture stimulation operations often require the concurrent use of multiple fracturing fluid pumping units at a single well in order to provide the desired quantity of fracturing fluid needed to fracture the earthen formation. Typically, multiple trailer or skid mounted hydraulic fracturing fluid pumping units, each including a single diesel motor, driveline and a single pump, are simultaneously used to provide the requisite demand of fracturing fluid into the well bore.

The need to use multiple vehicles, or pumping units, to fulfill fluid delivery demand into a well has one or more potential drawbacks. For example, each additional vehicle or pumping unit may increase the number of drivers and operators needed and personnel on site, the amount of undesirable exhaust emissions, the cost of operations and the potential for safety-related incidents. Also, the more pumping units needed on-site may limit the number of other important equipment that can be located at the well site at the same time.

Since time, cost, environmental impact and safety are of great concern in the hydrocarbon exploration and production industries, it is advantageous to simplify and improve operations and save time, money and manpower. In this instance, for example, it would be highly beneficial to reduce the number of vehicles, equipment and/or personnel needed at the well site during operations. For example, reducing the number of vehicles and pump units may, among other things, reduce costs, improve efficiency of overall operations, save time and delay caused by equipment failure and maintenance, reduce the number of drivers and operators needed, improve safety, reduces vehicle emissions, or a combination thereof.

It should be understood that the above-described examples, features, potential limitations and benefits are provided for illustrative purposes only and are not intended to limit the scope or subject matter of this disclosure, its claims or any related patents. Thus, none of the appended claims or claims of any related patent should be limited by the above examples, features, potential limitations and benefits, or required to address, include or exclude the above-cited examples, features, potential limitations and/or benefits merely because of their mention above.

Accordingly, there exists a need for improved systems, apparatus and methods useful in connection with downhole fluid delivery operations having one or more of the features, attributes or capabilities described or shown in, or as may be apparent from, the other portions of this patent.

BRIEF SUMMARY OF THE DISCLOSURE

In some embodiments, the present disclosure involves a mobile hydraulic fracturing fluid delivery system for pumping fracturing fluid into an underground well bore at a well site and being transportable between multiple well sites. The system includes a chassis configured to be transportable between well sites. An electric motor is disposed upon the chassis and electrically coupled to an external electric power source. The electric motor has first and second opposing ends and a drive shaft extending axially therethrough and outwardly therefrom at its opposing ends. A first fluid pump is disposed upon the chassis, coupled to the drive shaft of the electric motor at the first end thereof and configured to pump fracturing fluid into the well bore. A second fluid pump is disposed upon the chassis, coupled to the drive shaft of the electric motor at the second end thereof and configured to pump fracturing fluid into the well bore at the same time as the first fluid pump. The pumps are axially aligned with the electric motor at the opposing ends thereof. The drive shaft of the electric motor is coupled to the pumps so that the motor is capable of concurrently driving both pumps.

In various embodiments, the present disclosure involves a mobile high pressure fluid pumping unit for pumping high pressure fluid into an underground well bore at a well site and being transportable between multiple well sites. The unit includes a chassis configured to be transportable between well sites. First and second fluid pumps are disposed upon the chassis and configured to pump pressurized fluid into the well bore at the same time. An electric motor is disposed upon the chassis and configured to concurrently drive both pumps. A remotely controllable variable frequency drive (VFD) is also disposed upon the chassis and electrically coupled to the electric motor and an external electric power source. The VFD is configured to provide electric power to the electric motor from the external electric power source and allow the speed of the electric motor to be remotely controlled.

In many embodiments, the present disclosure involves an apparatus for pumping high pressure fluid into an underground well bore at a well site and being transportable between multiple well sites. The system includes, without limitation, a mobile chassis and an electric motor, first and second fluid pumps and a pair of high pressure elastic couplings mounted on the chassis. The chassis is configured to be transportable between well sites. The electric motor is electrically coupled to an external electric power source and has a drive shaft extending axially therethrough and outwardly therefrom at its first and second opposing ends. The first fluid pump is coupled to the drive shaft of the electric motor at the first end thereof and configured to pump high pressure fluid into the well bore, while the second fluid pump is coupled to the drive shaft of the motor at the second end thereof and configured to pump high pressure fluid into the well bore at the same time as the first pump. The drive shaft of the motor is coupled to the pumps so that the motor is capable of concurrently driving both pumps. The elastic couplings are engaged with and between the electric motor and the second respective pumps and configured to allow relative movement of the motor and pumps without disturbing the operation thereof.

The present disclosure also includes embodiments of a method of providing a high volume of pressurized fluid from a single mobile high pressure fluid delivery system into an underground well bore. On a single mobile chassis, first and second high pressure fluid pumps are positioned on opposing sides of an electric motor so that the fluid pumps and electric motor are axially aligned on the chassis. The electric motor is mechanically coupled to the fluid pumps so that the motor simultaneously drives both pumps to pump high pressure fluid into the well bore. The motor is configured to drive each pump regardless of the operation of the other pump. A remotely controllable variable frequency drive (VFD) disposed on the chassis is electrically coupled to the electric motor and an external electric power source. The VFD provides electric power to the motor from the external power source and allows the speed of the motor to be remotely controlled.

Accordingly, the present disclosure includes features and advantages which are believed to enable it to advance downhole fluid delivery operations. Characteristics and advantages of the present disclosure described above and additional features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF PREFERRED EMBODIMENTS

Figure 1:
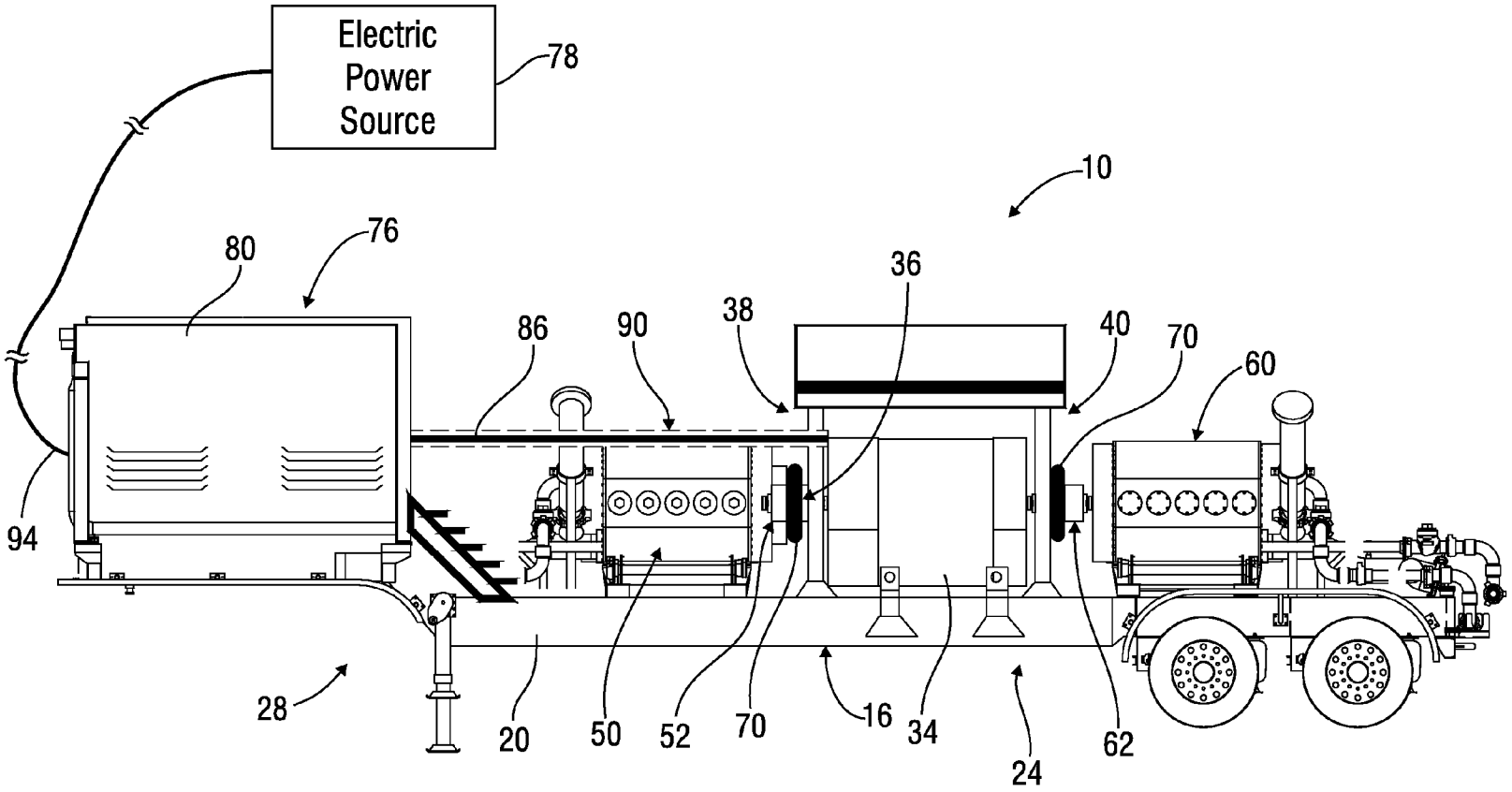
FIG. 1 is a side view of a fluid delivery system shown mounted on a trailer in accordance with an embodiment of the present disclosure.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent or any patent claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and describing preferred embodiments in the appended figures, common or similar elements are referenced with like or identical reference numerals or are apparent from the figures and/or the description herein. The figures are not necessarily to scale and certain features and certain views of the figures may be shown exaggerated in scale or in schematic in the interest of clarity and conciseness.

As used herein and throughout various portions (and headings) of this patent application, the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. The terms "coupled", "connected", "engaged" and the like, and variations thereof, as used herein and in the appended claims are intended to mean either an indirect or direct connection or engagement. Thus, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . . " Further, reference herein and in the appended claims to components and aspects in a singular tense does not necessarily limit the present disclosure or appended claims to only one such component or aspect, but should be interpreted generally to mean one or more, as may be suitable and desirable in each particular instance.

Referring initially to FIG. 1, in accordance with the present disclosure, an embodiment of a fluid delivery system 10 for providing a high volume of fluid from a mobile chassis 16 into an underground well bore (not shown) is shown. The chassis 16 may have any suitable form, configuration and operation. The illustrated chassis 16 is mounted on, or integral to, a carrier 24. As used herein and in the appended claims, the terms "carrier" and variations thereof means any transportable or movable device, such as, for example, a skid or other frame, trailer, truck, automobile and other types of land-based equipment, a ship, barge and other types of waterborne vessels, etc. In some embodiments, the chassis 16 and carrier 24 may essentially be one in the same, such as in some instances when the chassis 16 is a skid.

In this example, the carrier 24 is an 18-wheel trailer 28, and the chassis 16 includes an elongated frame 20 that is mounted on, or integral to, the trailer 28. The chassis 16 is thus transportable between locations, such as between multiple well sites. It should be understood, however, that the present disclosure is not limited by the type of chassis 16 or carrier 24.

The exemplary system 10 includes an electric motor 34 and first and second fluid pumps 50, 60, all disposed upon the chassis 16. The illustrated motor 34 drives the pumps 50, 60, which pump (typically pressurized) fluid into the well bore (not shown), such as for hydraulic fracturing of the adjacent earthen formation, acid stimulation, work-over or remediation operations, as is and may become further known. The system 10 thus doubles the fluid pumping capacity without weight penalty as compared to, for example, a conventional mobile hydraulic fracturing fluid pump unit having a diesel drive line and associated fluid pump.

The electric motor 34 and pumps 50, 60 may have any suitable form, configuration and operation. For example, the illustrated the motor 34 includes a drive shaft 36 (see also FIG. 2) extending axially therethrough and outwardly at its first and second opposing ends 38, 40 and coupled thereto to a respective drive shaft 52, 62 of each pump 50, 60. The exemplary pumps 50, 60 are thus generally axially aligned with the motor 34 at the opposing ends 38, 40 thereof. In this embodiment, the electric motor 34 is configured to drive the pumps 50, 60 concurrently, and if one of the pumps 50, 60 is not operating, the electric motor 34 still drives the other pump 50, 60 to pump fluid into the well bore (not shown). For example, check valves (not shown) associated with the respective pumps 50, 60 may be used to isolate the pumps 50, 60 from each other. Thus, the exemplary motor 34 is configured to drive each fluid pump 50, 60 regardless of the operation of the other fluid pump 50, 60

Any suitable motor 34 and pumps 50, 60 may be used. In this embodiment, the electric motor 34 may be a medium voltage motor, such as a permanent magnet AC motor having a power rating of 6,000 hp. The illustrated pumps 50, 60 may, for example, be high horsepower plunger-style, triplex or quintaplex, fluid pumps each having a power rating of 3,000 hp. For another example that may be particularly desirable in situations where minimizing the road weight of the carrier 24 is a top priority, the system 10 may including a motor 34 having a power rating of 5,000 hp and each pump 50, 60 having a power rating of 2,500 hp. A few currently commercially available electric motors that may be used as the motor 34 in the present embodiment are the Teratorq TT6000 being developed by Comprehensive Power, Inc. and the 5ZB105-6000 by Sichuan Honghua Petroleum Equipment Co., Ltd. A few currently commercially available fluid pumps that may be used as each of the pumps 50, 60 of this embodiment are suitable pumps manufactured by SPM, OPI, NOV, Gardener Denver, Wheatley and CAT. However, the present disclosure is not limited to the above details or examples.

It should be noted that the use of an electric motor 34 verses a conventional diesel motor has one or more advantage. For example, the electric motor 34 may require fewer related components (e.g. transmission, gear box) and thus have a lighter weight (and potentially smaller footprint). Reducing weight on the chassis 16 is beneficial, for example, in jurisdictions having weight limits on equipment transported to or located at a well site, allowing greater pumping capacity within strict weight requirements. For another example, reducing weight on the chassis 16 may enable inclusion of the second or additional fluid pumps on a single chassis 16, thus increasing pumping capacity. For another example, use of the electric motor 34 instead of one or more diesel motor may cause less undesirable exhaust emissions at the well site, reducing the need for on-site emissions control operations.

For yet another example, the electric motor 34 may not produce as much heat as the diesel motor. Consequently, if desired, a second electric motor 34 and second set of fluid pumps 50, 60 may be stacked atop the first set of electric motor 34 and fluid pumps 50, 60 on the chassis 16. (The second set of an electric motor and pumps may otherwise be configured and operate the same as described herein with respect to the electric motor 34 and pumps 50, 60.) Thus, the carrier 24 may have two sets of motors 34 and pumps 50, 60, essentially quadrupling the fluid pumping capacity of the system 10 as compared to a conventional system.

In some embodiments, the pumps 50, 60 may be mechanically coupled to the motor 34 with all their respective piston top-dead-center positions out of phase, or desynchronized. In such instance, no two cylinders of the pumps 50, 60 will fire synchronously, avoiding pressure spikes and providing more continuous or constant target pressure in the well bore (not shown). Depending upon the particular application, this may provide benefits, such as improving energy efficiency in operation of the system 10, improving control of pressure pulses and allowing the creation of deeper fractures in the earthen formation during hydraulic fracture stimulation operations.

Still referring to the embodiment of FIG. 1, if desired, a flex coupling 70 may be engaged between the motor 34 and each pump 50, 60. The flex couplings 70 may be useful, for example, to allow the motor 34 and pumps 50, 60 to move relative to one another during operations without disturbing their interconnection and operation or any other suitable purpose. Additional details about flex couplings in general, various different types of flex couplings and their operation may be found in publically available documents, such as the article "The Application of Flexible Couplings for Turbomachinery", by Robert E. Munyon, Jon R. Mancuso and C. B. Gibbons, Proceedings of the 18$^{th}$ Turbomachinery Symposium (copyright 1989), 25 pp., the entire contents of which are hereby incorporated by reference herein. However, the present disclosure is not limited by anything contained in this article.

The flex couplings 70 may have any suitable form, configuration and operation. For example, the flex couplings 70 may be commercially available high horsepower diaphragm, or elastic, couplings. One example of a currently commercially available flex coupling useful in the system 10 is a highly flexible coupling sold by KTR Couplings Limited and sized approximately for 15,000-18,000 ft/lb torque and 1000 rpm. Likewise, the flex couplings 70 may be engaged between the motor 34 and pumps 50, 60 in any suitable manner. For example, a flex coupling 70 may be disposed around the drive shaft 36 of the electric motor 34 at each end 38, 40 thereof. At each end 38, 40, the respective flex coupling 70 may be connected to and engaged between an oilfield drive-line flange (not shown) on the motor 34 and oilfield drive-line flange on the adjacent respective pump 50, 60. It should be understood, however, any suitable coupling may be used to allow relative movement of the motor 34 and pumps 50, 60 without disturbing the operation thereof, if desired.

The electric motor 34 may be controlled in any suitable manner. In this example, the speed of the electric motor 34 is controllable by a variable frequency drive (VFD) 76 disposed upon the chassis 16. The VFD 76 may be included because it is simple and easy to use, inexpensive, contributes to energy savings, increases the efficiency and life of, reduces mechanical wear upon and the need for repair of the electric motor 34, any other suitable purpose or a combination thereof. Further, positioning the VFD 76 on the chassis 16 eliminates the need for a separate trailer housing typically used to house the control system for conventional fracturing fluid pumping units.

Figure 2:
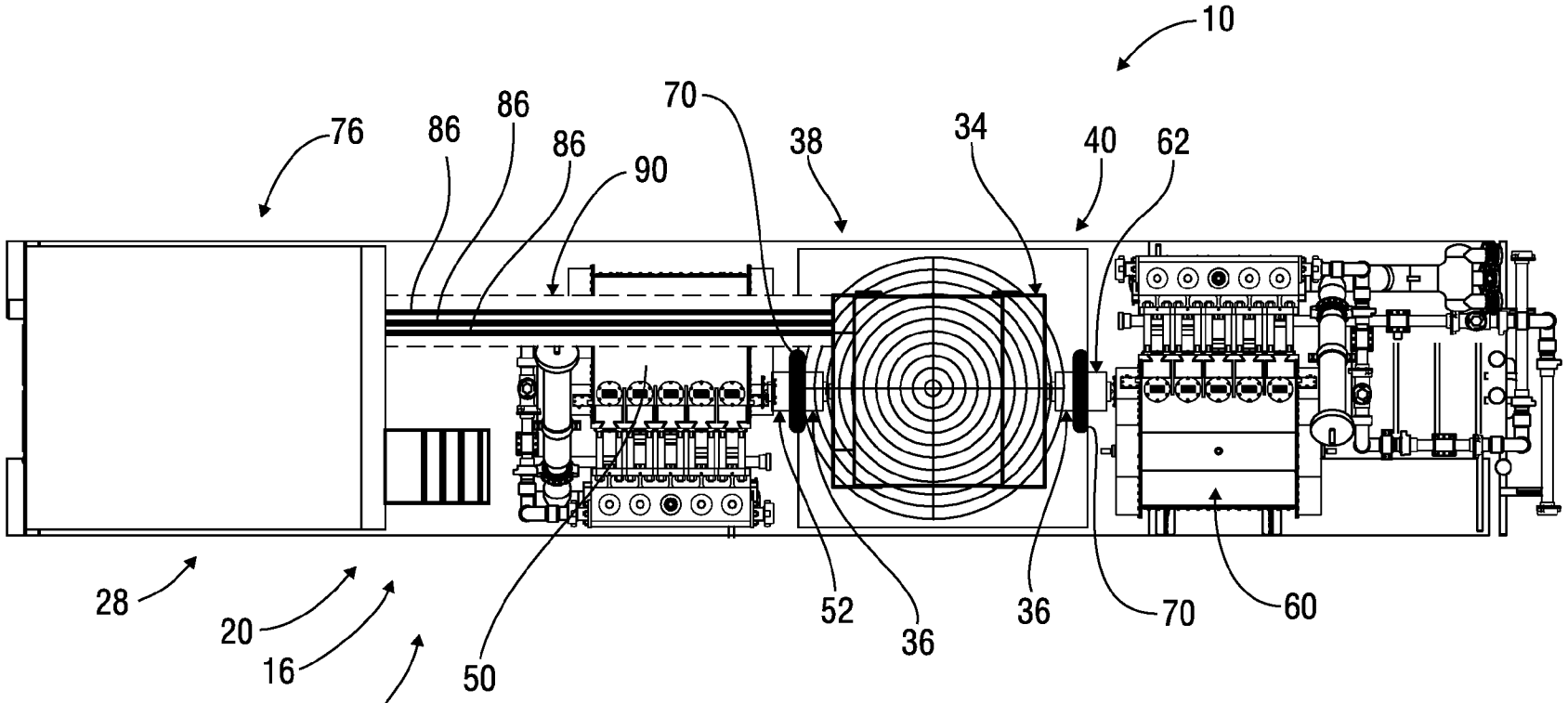
FIG. 2 is a top view of the exemplary fluid delivery system shown in FIG. 1.

The VFD 76 may have any suitable configuration, form and operation and may be connected with the motor 34 and at least one external electric power source 78 in any suitable manner. In this example, the VFD 76 is mounted on the chassis 16 behind a protective access panel 80, and electrically coupled to the electric motor 34 via one or more busbar 86. If desired, the busbar(s) 86 may be sized and configured to reduce or eliminate the loss of electric power occurring with the use of one or more interconnecting cable. Further, the use of busbars 86 may eliminate the need for a series of large cumbersome cables. The busbar(s) 86 may have any suitable form, configuration and operation. In this embodiment, as shown in FIG. 2, multiple busbars 86 are disposed upon a spring-loaded mounting (not shown) and at least partially covered and protected by a dust cover 90. However, the above configuration of a VFD 76 and busbars 86 is not required for all embodiments. Furthermore, any other suitable electric speed varying device known, or which becomes known, to persons skilled in the art can be used to provide electric power to the motor 34 from the external power source 78.

If desired, the VFD 76 may be remotely controllable via a remote control unit (not shown) located at a remote, or off-site, location, or via automatic control from an external process control signal. Remote control of the VFD 76 may be included for any suitable reason, such as to avoid the need for an on-site operator and/or to reduce cost and safety concerns. Any suitable technique may be used for remotely controlling the VFD 76, such as via wireless, fiber optics or cable connection. Alternately or additionally, the VFD 76 may include an operator interface (not shown) mounted on the chassis 16 to allow an on-site operator to control the VFD 76 (e.g. to start and stop the motor and adjust its operating speed and other functions) or override the remote control functions.

Still referring to the embodiment of FIG. 1, the system 10 is electrically coupled to at least one external electric power source 78 for providing electric power to the electric motor 34. The external electric power source 78 may have any suitable form, configuration, operation and location. If desired, the system 10 may be configured so that the external electric power source(s) 78 may be off-site relative to the location of the carrier 24, such as to reduce environmental and safety concerns at the well site or any other suitable reason. For example, the external electric power source 78 may be one or more gas turbine generator (not shown) remotely located relative to the well-site and electrically coupled to the VFD 76, such as with one or more medium voltage cable 94 (e.g. 15 kv class cable). For another example, the external electric power source 78 may be a local utility power grid remotely located relative to the well-site and connectable to the VFD 76 through any suitable source, such as distribution or transmission line, sub-station, breaker panel on another carrier (not shown). Thus, the system 10 may be transported between multiple well sites and connected to and disconnected from external power sources at each well site, or as desired.

It should be understood that the aforementioned components of the fluid delivery system 10 and further details of their form, configuration, operation and use are known in the art and described in publicly available documents. For example, information relevant to the present disclosure may be contained in U.S. Patent Publication Number 2012/0255734 having publication date Oct. 11, 2012 for application Ser. No. 13/441,334 to Coli et al., filed on Apr. 6, 2012 and entitled "Mobile, Modular, Electrically Powered System for use in Fracturing Underground Formations", the entire contents of which are hereby incorporated by reference herein. However, the present disclosure is not limited to the above-described components of the exemplary fluid delivery system 10 or any details of the above-referenced patent application, but may have additional or different components.

Preferred embodiments of the present disclosure thus offer advantages over the prior art and are well adapted to carry out one or more of the objects of this disclosure. However, the present disclosure does not require each of the components and acts described above and is in no way limited to the above-described embodiments or methods of operation. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims.

The methods that may be described above or claimed herein and any other methods which may fall within the scope of the appended claims can be performed in any desired suitable order and are not necessarily limited to any sequence described herein or as may be listed in the appended claims. Further, the methods of the present invention do not necessarily require use of the particular embodiments shown and described herein, but are equally applicable with any other suitable structure, form and configuration of components.

While exemplary embodiments of the invention have been shown and described, many variations, modifications and/or changes of the system, apparatus and methods of the present invention, such as in the components, details of construction and operation, arrangement of parts and/or methods of use, are possible, contemplated by the patent applicant(s), within the scope of the appended claims, and may be made and used by one of ordinary skill in the art without departing from the spirit or teachings of the invention and scope of appended claims. Thus, all matter herein set forth or shown in the accompanying drawings should be interpreted as illustrative, and the scope of the disclosure and the appended claims should not be limited to the embodiments described and shown herein.

The invention claimed is:

1. A mobile hydraulic fracturing fluid delivery system for pumping high pressure fracturing fluid into an underground well bore at a well site and being transportable between multiple well sites, the mobile hydraulic fracturing fluid delivery system comprising:

a chassis, said chassis being configured to be transportable between well sites;

an electric motor disposed upon said chassis, said electric motor being electrically coupled to an external electric power source and having first and second opposing ends, said electric motor further having a single drive shaft extending axially therethrough and outwardly therefrom at said first and second opposing ends thereof;

a first fluid pump disposed upon said chassis, coupled directly to said drive shaft of said electric motor at said first end of said motor and configured to pump fracturing fluid into the well bore;

a second fluid pump disposed upon said chassis, coupled directly to said drive shaft of said electric motor at said second end of said motor and configured to pump fracturing fluid into the well bore at the same time as said first fluid pump, wherein said first and second fluid pumps are axially aligned with said electric motor at said opposing ends thereof, further wherein said drive shaft of said electric motor is coupled to said first and second fluid pumps so that said electric motor is capable of concurrently driving both said fluid pumps;

at least a first flex coupling engaged with and between said electric motor and said first fluid pump and configured to allow movement of said electric motor and said first fluid pump relative to one another during and without disturbing the operation thereof; and at least a second flex coupling engaged with and between said electric motor and said second fluid pump and configured to allow movement of said electric motor and said second fluid pump relative to one another during and without disturbing the operation thereof.

2. The mobile hydraulic fracturing fluid delivery system of claim 1 wherein said electric motor is configured to drive each said fluid pump regardless of the operation of said other fluid pump.

3. The mobile hydraulic fracturing fluid delivery system of claim 1 wherein said electric motor has a power rating of 6,000 hp and each of said first and second fluid pumps has a power rating of 3,000 hp.

4. The mobile hydraulic fracturing fluid delivery system of claim 1 wherein said first and second fluid pumps are coupled to said drive shaft of said electric motor out of phase.

5. The mobile hydraulic fracturing fluid delivery system of claim 1 further including first and second said electric motors and first and second sets of said first and second fluid pumps disposed upon said chassis, wherein said second electric motor is stacked atop said first electric motor and said first and second fluid pumps of said second set are stacked atop said first and second fluid pumps of said first set, respectively.

6. The mobile hydraulic fracturing fluid delivery system of claim 1 further including a remotely controllable variable frequency drive disposed upon said chassis and electrically coupled to said electric motor, said variable frequency drive configured to control the speed of said electric motor.

7. The mobile hydraulic fracturing fluid delivery system of claim 6 wherein said variable frequency drive is configured to be electrically coupled to said external electric power source and provide electric power to said electric motor when said external electric power source is disposed at a remote location relative to said chassis.

8. The mobile hydraulic fracturing fluid delivery system of claim 7 wherein said external electric power source is one among a local utility power grid and a gas turbine generator.

9. The mobile hydraulic fracturing fluid delivery system of claim 6 further including at least one busbar disposed upon said chassis and engaged with, and configured to electrically connect, said variable frequency drive and said electric motor.

10. The mobile hydraulic fracturing fluid delivery system of claim 6 wherein said electric motor is an AC permanent magnet motor having a power rating of 5,000 hp.

11. The mobile hydraulic fracturing fluid delivery system of claim 10 wherein each fluid pump is a high horsepower plunger-style fluid pump having a power rating of 2,500 hp.

12. The mobile hydraulic fracturing fluid delivery system of claim 6 wherein said chassis is mounted upon one among a trailer and a skid.

13. A mobile high pressure fluid pumping unit for pumping high pressure fluid into an underground well bore at a well site and being transportable between multiple well sites, the mobile high pressure fluid pumping unit comprising:

a chassis, said chassis being configured to be transportable between well sites;

first and second fluid pump disposed upon said chassis and configured to pump pressurized fluid into the well bore at the same time;

an electric motor disposed upon said chassis, having first and second opposing ends, a single drive shaft extending axially therethrough and outwardly therefrom at said first and second opposing ends thereof and being configured to concurrently drive both said first and second fluid pumps, said first fluid pump being coupled directly to said drive shaft of said electric motor at said first end of said electric motor and said second fluid pump being coupled directly to said drive shaft of said electric motor at said second end of said electric motor;

at least a first high horsepower elastic coupling engaged with and between said electric motor and said first fluid pump and configured to allow movement of said electric motor and said first fluid pump relative to one another during and without disturbing the operation thereof;

at least a second high horsepower elastic coupling engaged with and between said electric motor and said second fluid pump and configured to allow movement of said electric motor and said second fluid pump relative to one another during and without disturbing the operation thereof; and a remotely controllable variable frequency drive disposed upon said chassis and electrically coupled to said electric motor and an external electric power source, said variable frequency drive being configured to provide electric power to said electric motor from said external electric power source and allow the speed of said electric motor to be remotely controlled.

14. The mobile high pressure fluid pumping unit of claim 13 further including at least one busbar disposed upon said chassis and engaged with, and configured to electrically connect, said variable frequency drive and said electric motor.

15. The mobile high pressure fluid pumping unit of claim 13 wherein said electric motor is configured to drive each said fluid pump regardless of the operation of said other fluid pump.

16. The mobile high pressure fluid pumping unit of claim 13 wherein said first and second fluid pumps are desynchronized.

17. The mobile high pressure fluid pumping unit of claim 13 further including first and second said electric motors and first and second sets of said first and second fluid pumps disposed upon said chassis, wherein said second electric motor is stacked atop said first electric motor and said first and second fluid pumps of said second set are stacked atop said first and second fluid pumps of said first set, respectively.

18. Apparatus for pumping high pressure fluid into an underground well bore at a well site and being transportable between multiple well sites, the apparatus comprising:

a mobile chassis, said chassis being configured to be transportable between well sites;

an electric motor disposed upon said chassis, said electric motor being electrically coupled to an external electric power source and having first and second opposing ends, said electric motor further having a single drive shaft extending axially therethrough and outwardly therefrom at said first and second opposing ends thereof;

a first fluid pump disposed upon said chassis, coupled directly to said drive shaft of said electric motor at said first end of said electric motor and configured to pump high pressure fluid into the well bore;

a second fluid pump disposed upon said chassis, coupled directly to said drive shaft of said electric motor at said second end of said electric motor and configured to pump high pressure fluid into the well bore at the same time as said first fluid pump; and first and second flex couplings engaged with and between said electric motor and said first and second respective fluid pumps and configured to allow relative movement of said electric motor and said first and second fluid pumps during and without disturbing the operation thereof, wherein said drive shaft of said electric motor is coupled to said first and second fluid pumps so that said electric motor is capable of concurrently driving both said fluid pumps.

19. A method of providing a high volume of pressurized fluid from a single mobile high pressure fluid delivery system into an underground well bore, the method comprising:

on a single mobile chassis, positioning first and second high pressure fluid pumps on opposing sides of an electric motor, wherein the fluid pumps and electric motor are axially aligned on the chassis, the electric motor having a single drive shaft extending axially therethrough and outwardly therefrom at its opposing sides;

mechanically coupling the fluid pumps directly to drive shaft of the electric motor at the respective opposing sides of the motor so that the electric motor is configured to simultaneously drive both pumps to pump high pressure fluid into the well bore, the electric motor being configured to drive each fluid pump regardless of the operation of the other fluid pump;

engaging at least a first flex coupling with and between the electric motor and the first fluid pump and configured to allow movement of the electric motor and the first fluid pump relative to one another during and without disturbing the operation thereof;

engaging at least a second flex coupling with and between the electric motor and the second fluid pump and configured to allow movement of the electric motor and the second fluid pump relative to one another during and without disturbing the operation thereof;

electrically connecting a remotely controllable variable frequency drive disposed on the chassis to the electric motor and an external electric power source; and the variable frequency drive providing electric power to the electric motor from the external electric power source and allowing the speed of the electric motor to be remotely controlled.

20. The method of claim 19 wherein the external electric power source is located remotely relative to the chassis, further including electrically coupling the variable frequency drive to the external electric power source with at least one cable.

21. The method of claim 19 wherein the first and second fluid pumps are mechanically coupled to the electric motor out of phase.

* * * * *